US011607027B2

(12) United States Patent
Carrick

(10) Patent No.: US 11,607,027 B2
(45) Date of Patent: Mar. 21, 2023

(54) TOOTHBRUSH AND CASE

(71) Applicant: Wayne Carrick, Taylors, SC (US)

(72) Inventor: Wayne Carrick, Taylors, SC (US)

( * ) Notice: Subject to any disclaimer, the term of this patent is extended or adjusted under 35 U.S.C. 154(b) by 260 days.

(21) Appl. No.: 15/930,986

(22) Filed: May 13, 2020

(65) Prior Publication Data

US 2020/0359772 A1 Nov. 19, 2020

Related U.S. Application Data

(60) Provisional application No. 62/847,034, filed on May 13, 2019.

(51) Int. Cl.
*A45D 44/18* (2006.01)
*A46B 17/04* (2006.01)

(52) U.S. Cl.
CPC ..... *A45D 44/18* (2013.01); *A46B 17/04* (2013.01); *A46B 2200/1066* (2013.01)

(58) Field of Classification Search
CPC ..... A45D 44/18; A45D 44/00; A45D 44/16; A46B 17/04; A46B 2200/1066; A46B 17/02; A46B 17/00; A46B 17/06; A46B 17/065
USPC ..... 206/361, 362, 362.1–362.3, 15.2, 15.3; 401/125, 270, 131, 48
See application file for complete search history.

(56) References Cited

U.S. PATENT DOCUMENTS 2,652,064 A * 9/1953 Shook ..... A45D 44/18 401/101
5,061,106 A 10/1991 Kent
5,375,711 A * 12/1994 Bree ..... A45D 44/18 206/362.2
5,876,134 A * 3/1999 Tseng ..... B43K 23/004 30/526
6,099,813 A * 8/2000 Gipson, II ..... A61L 2/18 D6/528
8,522,973 B2 * 9/2013 Joseph ..... B65D 51/248 206/362.2
2008/0202960 A1 * 8/2008 Donohue ..... A61L 2/18 53/469

(Continued)

FOREIGN PATENT DOCUMENTS

EP 0984709 B1 3/2000

OTHER PUBLICATIONS

Name: Wisemen Trading and Supply Product: Toothbrush Cover Sanitizer Website:https://wisementrading.com/health-and-safety/personal-care/tooth-brush/toothbrush-coversanitizer-2pk/ Publication Date: © 1998-2020.

*Primary Examiner* — David J Walczak
(74) *Attorney, Agent, or Firm* — Cynthia S. Lamon; Lamon Patent Services

(57) ABSTRACT

A toothbrush case has a first hollow body portion for enclosing the handle portion of a toothbrush, a second hollow body portion for enclosing the head of the toothbrush, the first and second hollow body portions removably fitted together to form a main case body. The toothbrush case also has a first removable cap for closing the free end of the first hollow body portion, and a second removable cap for closing the free end of the second hollow body portion and for enclosing a modular desiccant pod containing super absorbent material, the desiccant pod disposed proximal to the head of the toothbrush to absorb moisture from the enclosed toothbrush and from the internal volume of the toothbrush case.

13 Claims, 7 Drawing Sheets

(56) References Cited

U.S. PATENT DOCUMENTS

| | | | | |
|---|---|---|---|---|
| 2011/0067193 | A1 | 3/2011 | Olson | |
| 2011/0114124 | A1 | 5/2011 | Ryan | |
| 2013/0277254 | A1 * | 10/2013 | Hohlbein ..... | B65D 47/0847 206/369 |

* cited by examiner

TOOTHBRUSH AND CASE

CROSS-REFERENCE TO RELATED DOCUMENTS

The present invention claims priority to a provisional patent application Ser. No. 62/847,034 entitled Toothbrush Case, filed on May 13, 2019, disclosure of which is included herein at least by reference.

BACKGROUND OF THE INVENTION

1. Field of the Invention

The present invention is in the field of dental hygiene and health-related apparatus and pertains more particularly to a sanitary case for a holding a toothbrush.

2. Discussion of the State of the Art

In the field of dental hygiene, the toothbrush is the preferred tool for cleaning teeth. A toothbrush relies upon closely spaced bristles to clean teeth and get into the crevices between teeth and under the gum line. Typically, a toothbrush is used with tooth paste and water to clean teeth. A user typically applies paste on the brush, wets the brush, brushes teeth, and then rinses the brush.

A drawback of maintaining a sanitary state for a toothbrush is that it tends to retain moisture after use and rinse due to the closely spaced bristles of a toothbrush retaining water. A wet toothbrush may retain water for a considerable period. This water retention creates an ideal environment for microbial (including virus), and fungal growth.

More particularly, bacterial growth from an unsanitary toothbrush may introduce the bacteria while brushing, which may reproduce in the mouth. Bacteria introduced by unsanitary dental hygiene products have been linked to emergence of multiple disease processes, including esophageal cancer and heart disease, and more commonly gum disease.

Therefore what is clearly needed is an apparatus and method for eliminating the moisture retained in the form of water or water vapor by the bristles located on the head of a toothbrush in a timely manner, and that does not expose the toothbrush to potential airborne contaminants.

BRIEF SUMMARY OF THE INVENTION

According to an embodiment of the invention, a toothbrush case is provided and includes a first hollow body portion having a length and an internal volume sufficient for enclosing the handle portion of a toothbrush, a second hollow body portion having a length and an internal volume sufficient for enclosing the head of the toothbrush, the first and second hollow body portions removably fitted together to form a main case body, a first removable cap for closing the free end of the first hollow body portion, and a second removable cap for closing the free end of the second hollow body portion and for enclosing a modular desiccant pod containing super absorbent material, the desiccant pod disposed proximal to the head of the toothbrush to absorb moisture from the enclosed toothbrush and from the internal volume of the toothbrush case.

In one embodiment, the first and second hollow bodies are food grade plastic molded bodies. In one embodiment, the first and second hollow bodies are food grade metallic bodies. In one embodiment, the shape profile of the assembled toothbrush case matches the shape profile of the toothbrush. In one embodiment, the first and second removable caps are fabricated of a resilient rubber or rubberized material.

In one embodiment, the toothbrush case further includes a divider screen or perforated panel to separate the bristles on the head of the toothbrush from the desiccant pod within the second hollow body portion. In this embodiment, the divider screen or perforated panel is fabricated of a food grade plastic material or of a food grade metallic material. In one embodiment, the main case body is substantially conical in profile shape tapering down in dimension from base to top of the main body case.

In one embodiment, the toothbrush case of claim 1 further including a flexible rubber panel disposed between the first hollow body and the second hollow body, the rubber panel including a central opening through which the handle portion of the toothbrush is urged, the opening resilient to form a contact seal around the toothbrush handle. In this embodiment, the divider screen or perforated panel presents orthogonally within the second hollow body portion to the direction of the bristles on the head of the toothbrush. In one embodiment where the toothbrush case has a divider screen, the divider screen or perforated panel is supported on a shelf machined into or otherwise provided in the sidewall or sidewalls of the second hollow body portion.

In one embodiment, the toothbrush case further includes a third hollow body adapted as a toothbrush handle holder to hold the toothbrush in a secure position within the main case body. In this embodiment, the third hollow body fits within the first and second hollow bodies.

DETAILED DESCRIPTION OF THE INVENTION

In various embodiments described in enabling detail herein, the inventor provides a unique water absorbing case for storing at least the bristled head of a toothbrush in a manner that prevents moisture left over from toothbrush use from lingering within the bristle structure of the brush. The present invention is described using the following examples, which may describe more than one relevant embodiment falling within the scope of the invention. It is a goal of the invention to provide a toothbrush case having a desiccant for absorbing moisture from the toothbrush head and bristles and for absorbing moisture from the inside of the case.

Figure 1:
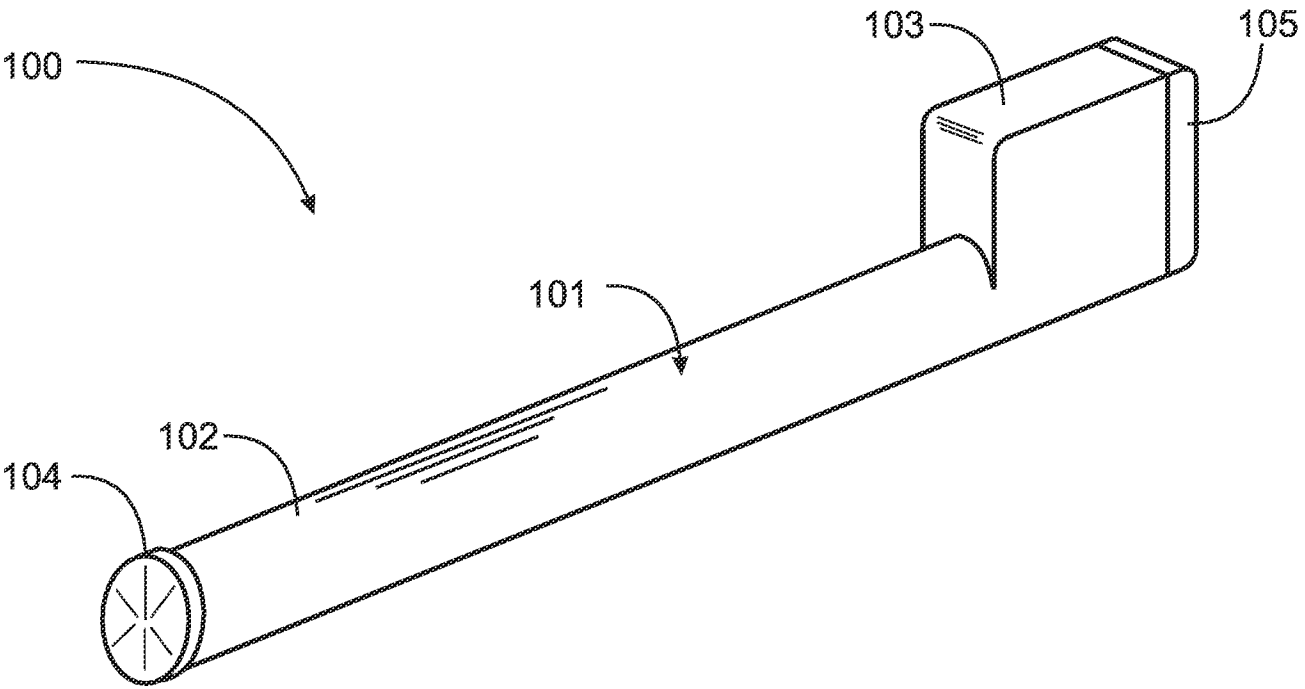
FIG. 1 is a perspective view of a toothbrush case according to an embodiment of the present invention.

FIG. 1 is a perspective view of a toothbrush case 100 according to an embodiment of the present invention. Toothbrush case 100 may be fabricated from a food grade polymer material in the form of a plastic molded body 101. Body 101 may also be manufactured from a variety of other materials including food grade metals and other types of materials that may have anti-corrosive properties.

In this embodiment, body 101 has two hollow portions. A first portion is referenced herein as tube 102. Tube 102 is hollow and holds the handle end of a toothbrush. In one embodiment, a toothbrush may be left in tube 102 during use and may be stored therein after use as is described more fully below. A second portion is referenced herein as enclosure 103. Enclosure 103 is mostly hollow and has enough space to enclose the head of a toothbrush containing the bristles.

In this embodiment, both ends of toothbrush case 100 are capped. Case 100 includes a first removable cap 104 for capping the open end of tube 102 and a second removable cap 105 for capping the open end of enclosure 103. In one embodiment, cap 104 and cap 105 include polymer seals rendering body 101 airtight when caps are installed. Thus, a closed system for enclosing a toothbrush is provided having no air passages to provide ventilation or possible introduction of airborne contaminants.

Toothbrush case 100 may be accessed and cleaned thoroughly with access to the interior of body 101 provided through the opposing openings closed by cap 104 and cap 105. Enclosure 103 includes enough internal volume to enclose the head of a toothbrush and a desiccant pod (not visible) adapted to absorb moisture. A sub-enclosure or compartment may be provided within enclosure 103 and may be adapted to hold a desiccant pod in general proximity to the bristle structure of the toothbrush.

In this embodiment, tube 102 is annular in profile; however, tube 102 may be fabricated or molded into other geometric profiles that may be deemed appropriate without departing from the spirit and scope of the present invention. Enclosure 103 is a rectangular enclosure in this embodiment; however, enclosure 103 may be fabricated or molded into other geometric profiles that may be deemed appropriate without departing from the spirit and scope of the present invention.

Figure 2:
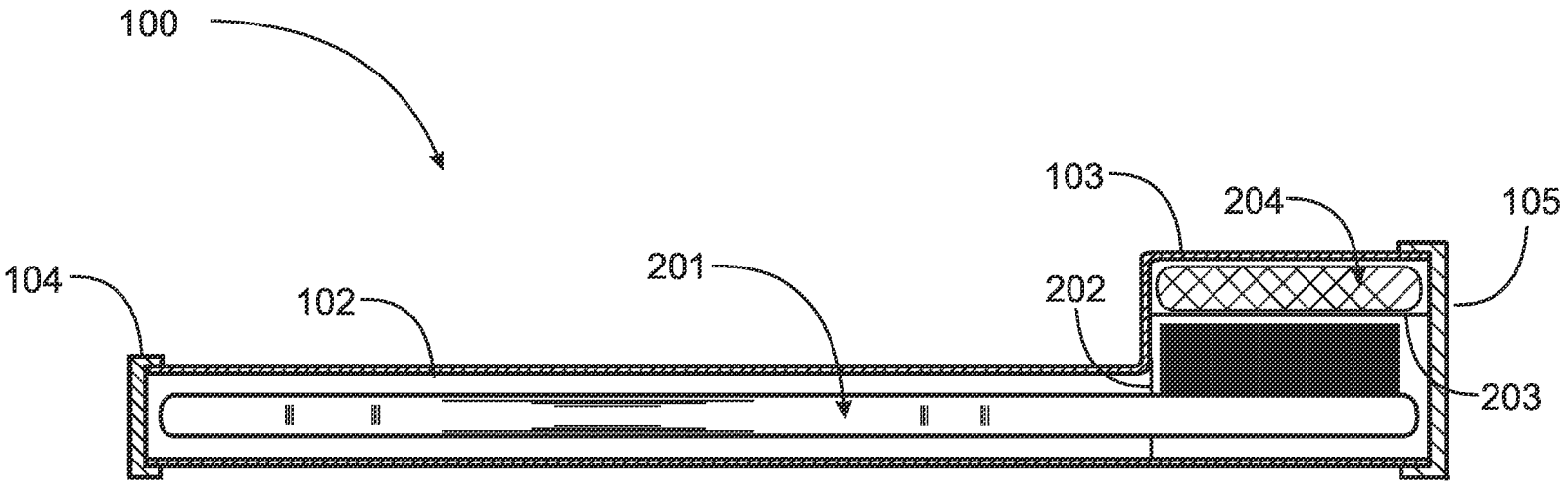
FIG. 2 is a sectioned view of a toothbrush case taken longitudinally with the toothbrush case depicted enclosing a stored toothbrush.

FIG. 2 is a sectioned view of toothbrush case 100 of FIG. 1 taken longitudinally the toothbrush case depicted enclosing a stored toothbrush. End caps 104 and 105 are depicted in section in place at each end of toothbrush case 100. A toothbrush 201 is depicted inside toothbrush case 100. The handle portion of toothbrush 201 is enclosed by tube 102 and the head portion of toothbrush 201 is enclosed by enclosure 103.

Enclosure 103 of toothbrush case 100 may include a porous compartment divider 203 located just above the bristle structure of toothbrush 201, the bristles facing upward in enclosure 203. In one embodiment, compartment divider 203 may be a thin stainless-steel screen or a steel perforated panel. In another embodiment, divider 203 may be a plastic screen or a perforated panel.

Divider 203 presents horizontally across the entire internal footprint of enclosure 103 and may be supported in position within enclosure 103 by lateral slots or shelves created in the sidewalls of enclosure 103. Divider 203 is adapted as a porous barrier between a desiccant pod 204 and the toothbrush bristle structure within enclosure 103.

In one embodiment, shelves, or ledges (not visible) may be created in the side walls of enclosure 103 and adapted dimensionally to hold desiccant pod 204 without the aid of divider screen 203. In one embodiment, the tips of the bristle structure of toothbrush 201 may have near physical contact or direct physical contact with desiccant pod 204 in place enabling direct or near direct contact between the bristles of toothbrush 201 and the desiccant pod 204. In this implementation, divider 203 is adapted as a physical barrier that provides a separate compartment above the bristles of toothbrush 201 where the desiccant pod 204 may be placed, while enabling proximity of the pod 204 to the bristle structure of toothbrush 201. Desiccant pod 204 absorbs moisture and dries the bristles of toothbrush 201, preventing a potential favorable environment for microbes including harmful bacterium to reproduce.

Desiccant Pod 204 may have a length and width that conforms to the rectangular footprint of the bristle structure of toothbrush 201; therefore, sized to be comfortably inserted into enclosure 103 above the bristles of toothbrush 201 and divider 203. Desiccant pod 204 may include a super absorbent material like silica gel and/or a super absorbent polymer material enclosed in a porous fabric covering. There are a variety of desiccant materials known in the art, many of them useful in implementation of the present invention. The fabric covering of desiccant pod 204 may be fabricated from porous natural fibers that may permit the maximum passage of water and or water vapor into the super absorbent materials contained within the covering. In use, water and vapor molecules are drawn from the bristle structure of toothbrush 201, through compartment divider 203 (if used) and directly into the desiccant pod 204 material where it can be absorbed and stored until saturated. Desiccant pod 204 may be replaced by a new desiccant pod 204 whenever required. The covering of desiccant pod 204 may be fabricated using synthetic materials without departing from the spirit and scope of the invention. A common feature of materials that is required is the porosity to allow water and or water vapor from the bristle structure of toothbrush 201 to pass into the super absorbent materials of pod 204 relatively freely.

In practice of the present invention, a user may remove cap 105 from empty toothbrush case 100 and may insert a toothbrush 201, handle first, into a storing position aligning the head of the brush 201 to be accepted within enclosure 103. In one embodiment, a thin rubber or flexible polymer panel 202 may be provided and may be adapted to separate tube 102 of toothbrush case 100 from enclosure 103 of toothbrush case 100. In this embodiment, panel 202 may have a central opening provided there through, the opening of a size to allow the handle of toothbrush 201 to be pushed through a rubber film panel 202, the film panel 202 forming a contact seal around the toothbrush handle of toothbrush 201. In another embodiment, there is no panel 202 and the desiccant pod 204 absorbs moisture from the handle of toothbrush 201 in tube portion 102 as well as from the bristle structure of toothbrush 201 in enclosure 103.

A user may remove cap 105 and place desiccant pod 204 in enclosure 103 (compartment) above the bristle architecture of toothbrush 201. Desiccant pod 204 absorbs moisture while the toothbrush 201 is fully enclosed with both caps 104 and 105 in place. A user may place toothbrush case 100 with toothbrush 201 inside face down on a surface enabling gravity to aid in the flow of moisture from at least the bristle structure of toothbrush 201 to the desiccant pod 204.

Desiccant pod 204 may have enough super absorbent material to dry a toothbrush several times without requiring replacement. Desiccant pod 204 may be easily replaced with a new desiccant pod 204 when saturated or no longer able to absorb moisture in a timely fashion. Caps 104 and 105 are provided to enable access to toothbrush case 100 for cleaning. The dry state of the super absorbent desiccant material in pod 204 creates a target for moisture in the form of water vapor humidity in the air space of the case, the pod 204 functioning as an air wick lowering the humidity state of the air trapped within toothbrush case 100. In one embodiment, the super absorbent desiccant materials and boundary fabric are made from natural biodegradable materials.

Figure 3:
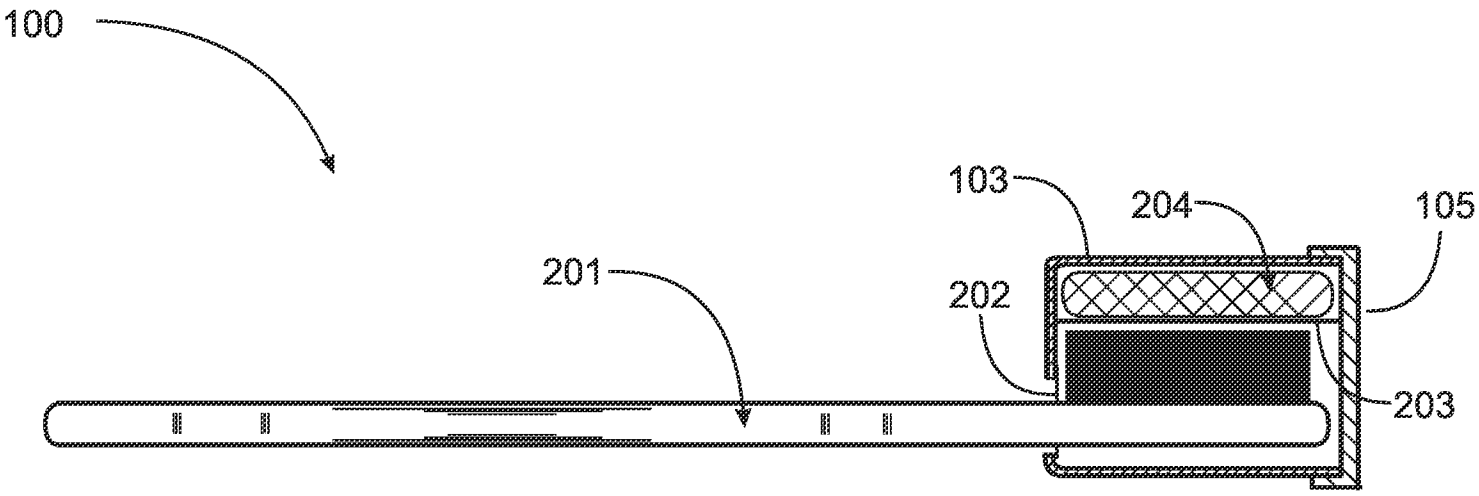
FIG. 3 is a side elevation view of a toothbrush case according to an alternative embodiment of the invention.

FIG. 3 is an elevation view of toothbrush case 100 according to an alternative embodiment of the invention. In an alternative embodiment, toothbrush case 100 does not have a tube 102 or cap 104 for enclosing the handle portion of toothbrush 201. In this embodiment, enclosure 103 terminates at rubber panel 202 and contains screen 203 and pod 204. In this embodiment a user may remove cap 105, insert toothbrush 201 handle first through enclosure 103 and past the central opening of panel 202. The rubber material of panel 202 is resilient and forms a contact seal against the handle behind the bristle structure.

Figure 4:
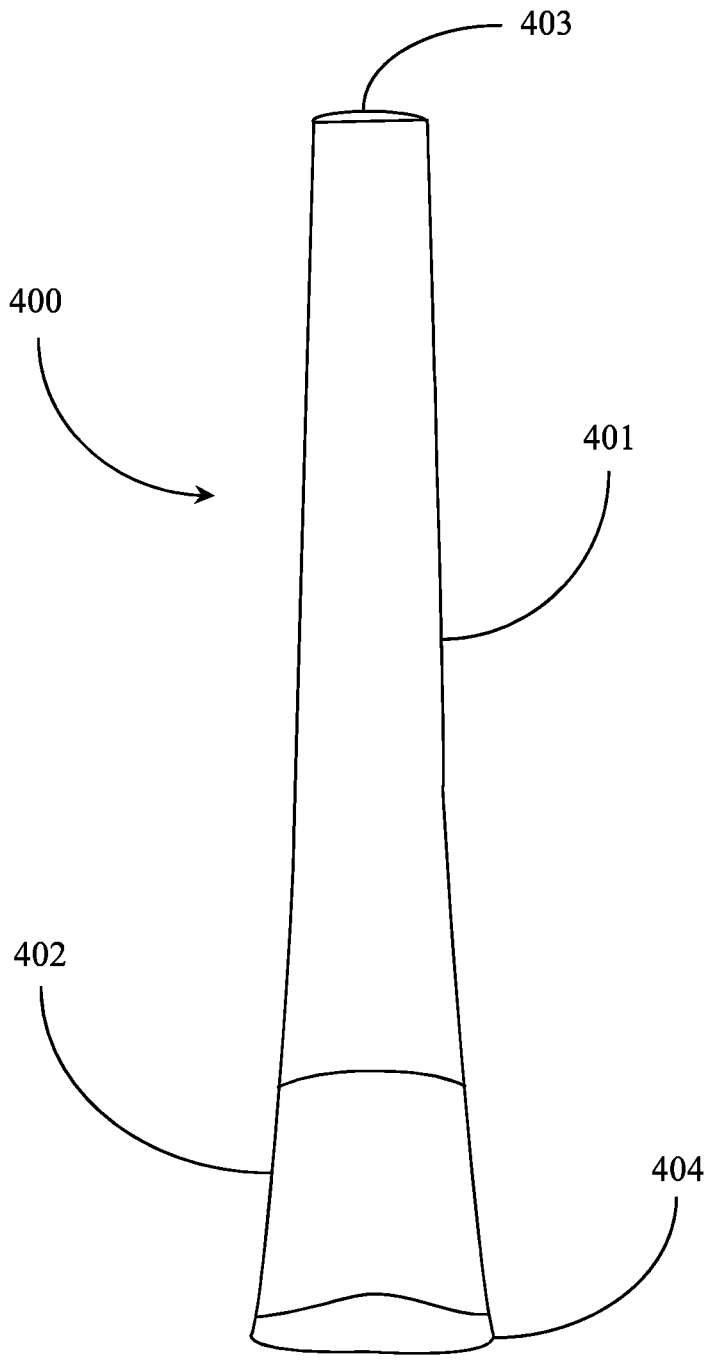
FIG. 4 is an elevation view of a vertical toothbrush case according to another embodiment of the present invention.

FIG. 4 is an elevation view of vertical toothbrush case 400 according to another embodiment of the present invention. In one embodiment of the present invention, vertical toothbrush case 400 is adapted to enclose a toothbrush in a vertical position. Toothbrush case 400 like toothbrush case 100 may be fabricated from the same materials mentioned further above. Vertical toothbrush case 400 is adapted as a plastic molded assembled body including a first tube portion 401 similar in function to tube 102 of FIG. 1, and a second enclosure portion 402 similar in function to enclosure 103 of FIG. 1. Tube 401 is hollow and holds the handle end of a toothbrush. A toothbrush may be left in tube 401 during use and may be stored therein after use. Enclosure 402 is mostly hollow and has enough space to enclose the head of a toothbrush containing the bristles.

Both ends of vertical toothbrush case 400 are capped. Vertical toothbrush case 400 includes a first removable cap 403 for capping the open end of tube 401 and a second removable cap 404 for capping the open end of enclosure 402. In one embodiment, cap 403 and cap 404 include polymer seals rendering vertical toothbrush case 400 airtight when the caps are installed.

Figure 5:
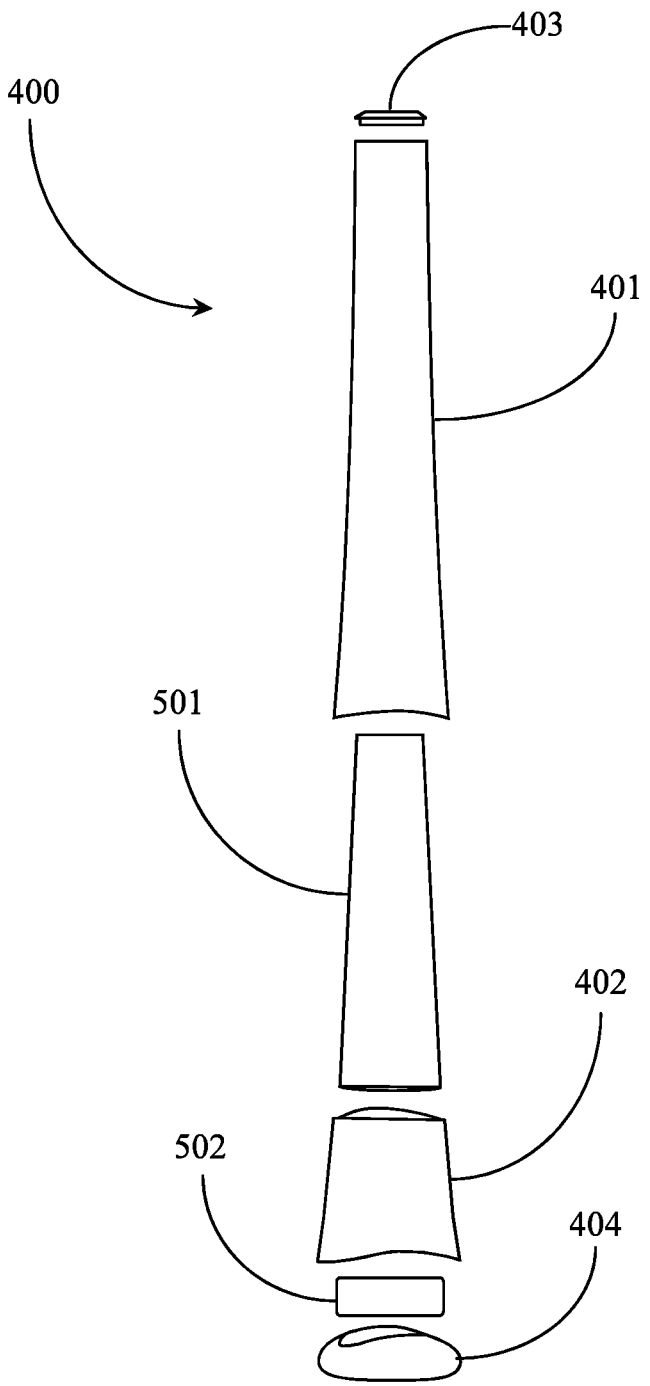
FIG. 5 is an exploded view of the vertical toothbrush case of FIG. 4.

FIG. 5 is an exploded view of vertical toothbrush case 400 of FIG. 4. Vertical toothbrush case 400 is adapted to stand vertically on a table or counter by virtue of rubberized cap 404 having a large base diameter. A desiccant pod 502 is analogous to desiccant pod 204 of FIG. 2 above in function and in materials. Enclosure 402 encloses the bristle structure of a toothbrush.

Vertical toothbrush case 400 includes a third hollow portion adapted as a toothbrush handle holder 501. Handle holder 501 may be kept on a toothbrush handle when brushing. Handle holder 501 may be adapted in this design to fit down inside the body formed by tube 401 and enclosure 402 and may remain over the toothbrush handle when in storage inside the case. Handle holder 501 may also be adapted to hold the toothbrush in a secure position within the case 400, not letting the brush head slip or shift within the case.

Cap 404 provides a snug seat for desiccant pod 502. Vertical toothbrush case 400 holds a toothbrush head down. Desiccant pod 502 is positioned differently in this embodiment, more particularly beneath the far end of the bristle structure of an enclosed toothbrush rather than adjacent to the bristle ends. Toothbrush handle holder 501 is not specifically required to practice the invention. Toothbrush handle holder 501 may be a plastic molded part that fits over and clamps to or stops against the handle of a toothbrush such that a user may operate the brush by the handle holder. Handle holder 501 as a conical shape in this example and seats into tube 401 and into enclosure 402. Tube 401 has a sealed cap 403 to prevent outside bacteria from entering case 400.

Figure 6:
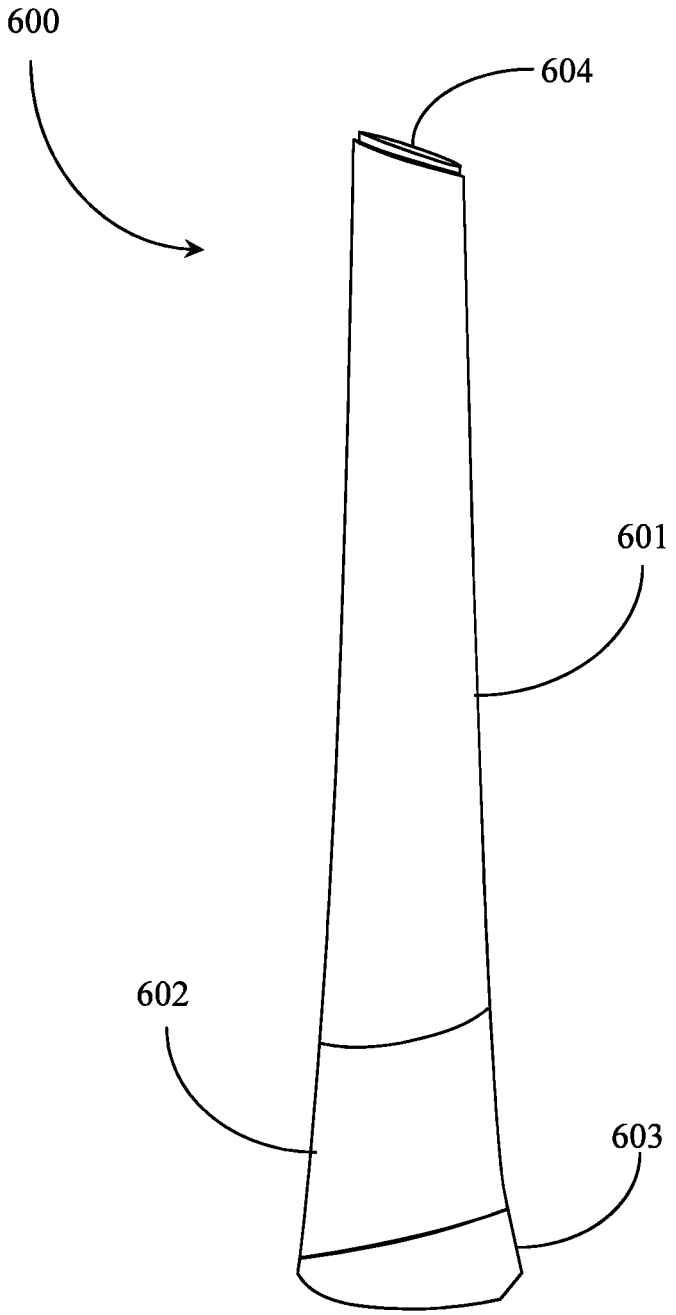
FIG. 6 is an elevation view of a vertical toothbrush case having a modified design.

FIG. 6 is a side elevation view of vertical toothbrush case 600 having a modified design. Vertical toothbrush case 600 is analogous in materials and function with vertical toothbrush case 400 of FIG. 4. In this embodiment, an assembled body includes a first tube portion 601 analogous in basic function and materials with tube 401 of FIG. 4, and a second enclosure portion 602 analogous in basic function and materials to enclosure 402 of FIG. 4. In this design, tube 601 has a free end that is angle cut. A removable cap 604 is provided and is modified in design to close the opening. Enclosure 602 has a free end that is angle cut. A removable cap 603 is provided and is modified in this design to close the opening.

Figure 7A:
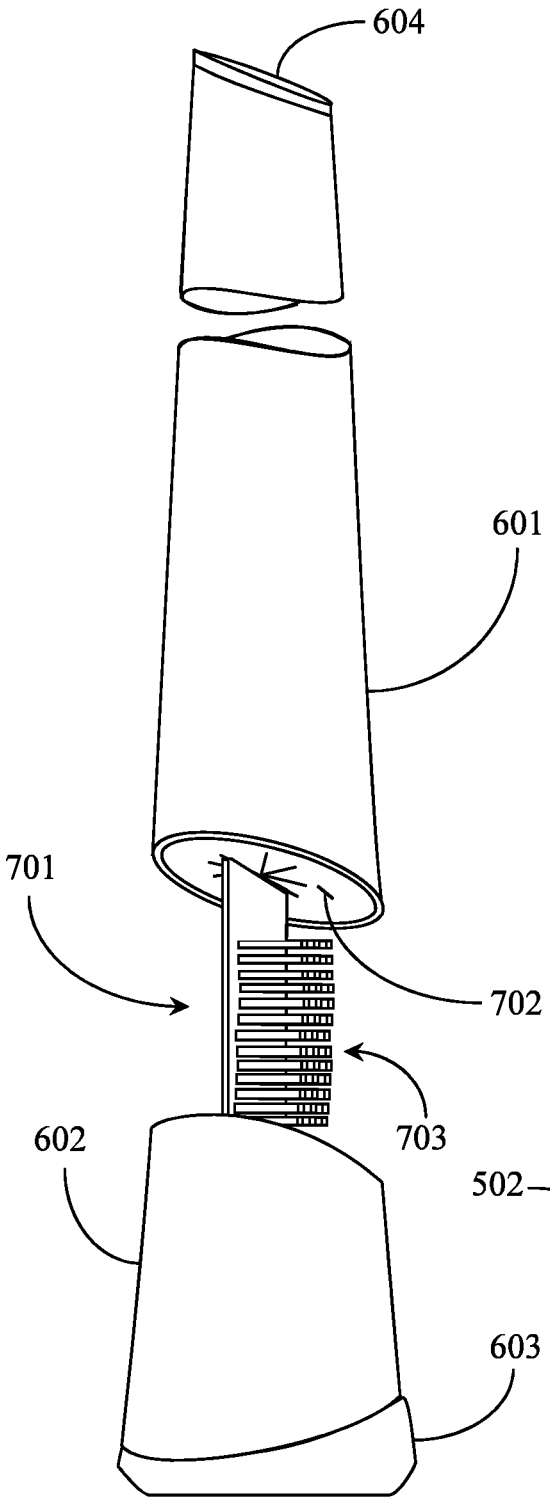
FIG. 7A is an exploded partial view of the vertical toothbrush case of FIG. 6 depicted enclosing a stored toothbrush.

FIG. 7A is an exploded partial view of vertical toothbrush case 600 of FIG. 6 depicted enclosing a stored toothbrush 703. In this view, the upper portion of tube 601 and removable cap for that end are not visible. Tube 601 fits into enclosure 602. The interfacing ends of tube 601 and enclosure 602 are aligned according to the angle cut plane when fitted together. Removable cap 603 is modified in design from other caps described herein to accept and cover the angle cut end of enclosure 602. Cap 603 has a flat cap surface that presents horizontal when the cap 603 is in place so that vertical toothbrush 600 may be placed upright on a table or counter with the head of the toothbrush 703 facing downward in close proximity to the pod 502.

In this embodiment a thin rubber or flexible polymer panel 702 may be provided to separate tube 601 and enclosure 602 of vertical toothbrush case 600. Like panel 202 of FIG. 2, panel 702 may have a central opening provided there through, the opening small enough to allow the handle of an enclosed toothbrush 701 to be pushed through the rubber film, the film forming a contact seal around the toothbrush handle. In general, versions of the toothbrush case that have parts with angle cuts at the interfacing ends typically aid in proper alignment of the toothbrush inside the case and reducing the chance of a shift in the alignment.

Figure 7B:
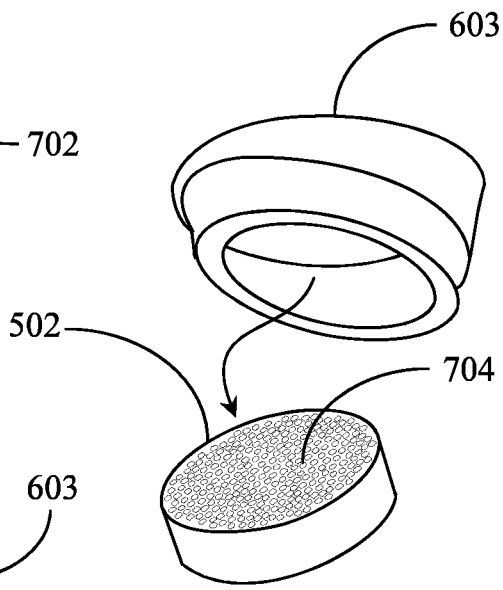
FIG. 7B is an exploded perspective view of the cap of the toothbrush case of FIG. 6 ejecting a desiccant pod.

FIG. 7B is an exploded perspective view of cap 603 of vertical toothbrush case 600 of FIG. 6 ejecting a desiccant pod. In this view cap 603 is shown in an inverted position to pop out desiccant pod 502 (introduced and described in FIG. 5). Desiccant pod 502 may be a perforated polymer disk that has a pattern of perforations 704 on one or more than one disk surface. Pod 503 contains the super absorbent materials analogous in function to those described relative to desiccant pod 204 of FIG. 2. When desiccant pod 502 becomes saturated, a user may pop it out of its seat in cap 603 in the direction of the arrow and may insert a new pod. Perforations 704 direct moisture into the super absorbent materials in a uniform manner.

It will be apparent to one with skills in the art that the present invention may be provided using some of or all the described elements without departing from the spirit and scope of the present invention. The arrangement of elements and functionality for the invention is described in different embodiments and designs in which each is exemplary of an implementation of the invention. For example, in one embodiment the majority of the parts may formed in an integral manner wherein only the pod 502 and cap 404 are detachable from the case 600, leaving the case as an integral case including formed components 401, 402, 403, and 501. These exemplary descriptions do not preclude other implementations and use cases not described in detail. The invention is limited only by the breadth of the claims below.

The invention claimed is:

1. A toothbrush case comprising:

a first hollow body portion having a first open end, a second open end, a length, a width, a height, and an internal volume, the length, width, height, and internal volume sufficient for enclosing a handle portion of a toothbrush;

a second hollow body portion having a first open end, a second open end, a length, a width, a height, and an internal volume, the length, width, height, and internal volume sufficient for enclosing a head of the toothbrush and a modular desiccant pod;

a first removable cap for closing the first open end of the first hollow body portion;

a second removable cap for closing the first open end of the second hollow body portion and for enclosing the modular desiccant pod;

wherein the second open end of the first hollow body portion and the second open end of the second hollow body portion are removably fitted together to form an enclosed main case body and the second hollow body portion contains at least one of a porous divider, shelve, or ledges, adapted to hold the desiccant pod within the second hollow body portion disposed proximally to the head of the toothbrush, enabling the desiccant pod to absorb moisture from the head of the toothbrush and from the second hollow body portion.

2. The toothbrush case of claim 1, wherein the first and second hollow bodies are food grade plastic molded bodies.

3. The toothbrush case of claim 1, wherein the first and second hollow bodies are food grade metallic bodies.

4. The toothbrush case of claim 1, wherein a shape profile of the assembled toothbrush case matches a shape profile of the toothbrush.

5. The toothbrush case of claim 1, wherein the first and second removable caps are fabricated of a resilient rubber or rubberized material.

6. The toothbrush case of claim 1 further including:

a divider screen or perforated panel to separate bristles on the head of the toothbrush from the desiccant pod within the second hollow body portion.

7. The toothbrush case of claim 6, wherein the divider screen or perforated panel presents orthogonally within the second hollow body portion to an orientation of the bristles on the head of the toothbrush.

8. The toothbrush case of claim 6, wherein the divider screen or perforated panel is supported on a shelf machined into or otherwise provided in a sidewall or sidewalls of the second hollow body portion.

9. The toothbrush case of claim 6, wherein the divider screen or perforated panel is fabricated of a food grade plastic material or of a food grade metallic material.

10. The toothbrush case of claim 1, wherein the main case body is substantially conical in profile shape tapering down in dimension from base to top of the main body case.

11. The toothbrush case of claim 10 further including:

a third hollow body adapted as a toothbrush handle holder adapted to hold the toothbrush in a secure position within the main case body.

12. The toothbrush case of claim 11 wherein the third hollow body fits within the first and second hollow bodies.

13. The toothbrush case of claim 1 further including:

a flexible rubber panel disposed between the first hollow body and the second hollow body, the rubber panel including a central opening through which the handle portion of the toothbrush is urged, the opening resilient to form a contact seal around the handle portion of the toothbrush.

* * * * *